US008522939B2

(12) United States Patent
Rowe

(10) Patent No.: US 8,522,939 B2
(45) Date of Patent: Sep. 3, 2013

(54) STORAGE BAG WITH SECONDARY ACCESS

(75) Inventor: Michael D. Rowe, Medway, OH (US)

(73) Assignee: Acco Brands Corporation, Lake Zurich, IL (US)

( * ) Notice: Subject to any disclaimer, the term of this patent is extended or adjusted under 35 U.S.C. 154(b) by 0 days.

(21) Appl. No.: 13/270,514

(22) Filed: Oct. 11, 2011

(65) Prior Publication Data

US 2012/0097494 A1 Apr. 26, 2012

Related U.S. Application Data

(60) Provisional application No. 61/406,277, filed on Oct. 25, 2010.

(51) Int. Cl.
*A45C 3/00* (2006.01)

(52) U.S. Cl.
USPC ..... 190/112; 190/109; 190/902; 206/320; 383/41

(58) Field of Classification Search
USPC ..... 190/109, 111, 112, 902; 383/41; 206/320
See application file for complete search history.

(56) References Cited

U.S. PATENT DOCUMENTS

| | | | | |
|---|---|---|---|---|
| D106,446 | S | 10/1937 | Laufman | |
| 2,213,821 | A * | 9/1940 | McCurdy | 190/111 |
| 3,708,045 | A | 1/1973 | Katz | |
| 3,912,055 | A * | 10/1975 | Malooly | 190/109 |
| 4,067,422 | A | 1/1978 | Eberle | |
| 4,236,615 | A | 12/1980 | Ginat | |
| 4,513,866 | A | 4/1985 | Thomas | |
| 4,817,802 | A | 4/1989 | Pratt | |
| 5,042,664 | A | 8/1991 | Shyr et al. | |
| 5,090,526 | A | 2/1992 | Jacober | |
| 5,105,920 | A * | 4/1992 | Grebenstein | 190/18 A |
| 5,323,897 | A | 6/1994 | Sperber | |
| 5,494,157 | A | 2/1996 | Golenz et al. | |
| 5,529,229 | A | 6/1996 | Fier | |
| 5,544,792 | A | 8/1996 | Arnwine | |
| 5,704,529 | A | 1/1998 | Santoro et al. | |
| 5,749,503 | A | 5/1998 | Wulf et al. | |
| 5,797,529 | A | 8/1998 | Lavine | |
| D402,460 | S | 12/1998 | Moor | |
| 5,878,757 | A | 3/1999 | Hernandez | |
| 5,887,770 | A | 3/1999 | Covell | |

(Continued)

FOREIGN PATENT DOCUMENTS

| | | |
|---|---|---|
| CA | 2180739 | 5/1996 |
| DE | 2022004015475 U | 2/2005 |

OTHER PUBLICATIONS

OGIO Locker Bag Reference.

*Primary Examiner* — Sue A Weaver
(74) *Attorney, Agent, or Firm* — Thompson Hine L.L.P.

(57) ABSTRACT

A storage bag including an outer casing having an inner compartment configured to store a laptop computer or laptop computer-sized item therein. The bag further includes a first access opening formed at or along an upper edge of the inner compartment and communicating with the inner compartment. The first access opening is sized to allow a laptop computer or laptop computer-sized item to pass therethrough and into the inner compartment. The bag also has a second access opening formed along a back surface of the outer casing and communicating with the inner compartment. The second access opening is sized to allow a laptop computer or laptop computer-sized item to pass therethrough and into the inner compartment.

19 Claims, 6 Drawing Sheets

(56) References Cited

U.S. PATENT DOCUMENTS

| | | | | |
|---|---|---|---|---|
| 5,911,262 | A * | 6/1999 | Steinhart | 150/103 |
| 5,967,270 | A * | 10/1999 | Shyr | 190/109 |
| 6,053,382 | A | 4/2000 | Wyant | |
| 6,059,079 | A * | 5/2000 | Krulik | 190/112 |
| 6,105,763 | A | 8/2000 | Saetia | |
| 6,179,187 | B1 | 1/2001 | Lemire et al. | |
| 6,286,461 | B1 | 9/2001 | Martz | |
| 6,354,477 | B1 | 3/2002 | Trummer | |
| 6,435,390 | B1 | 8/2002 | Abramowicz | |
| 6,481,574 | B1 * | 11/2002 | Pakosh | 206/285 |
| 6,516,751 | B2 | 2/2003 | Burns et al. | |
| D508,315 | S | 8/2005 | Han | |
| 6,994,132 | B2 | 2/2006 | Antrobus | |
| 7,374,183 | B1 | 5/2008 | Yen-Lung | |
| 7,419,037 | B2 | 9/2008 | Nordstrom | |
| 7,481,317 | B2 | 1/2009 | Brim | |
| 7,588,146 | B1 | 9/2009 | Salander et al. | |
| 2002/0000390 | A1 * | 1/2002 | Hollingsworth | 206/320 |
| 2002/0027052 | A1 * | 3/2002 | Godshaw et al. | 190/111 |
| 2003/0024960 | A1 | 2/2003 | Greenstein et al. | |
| 2003/0127060 | A1 | 7/2003 | Yeung | |
| 2004/0099496 | A1 * | 5/2004 | Hollingsworth | 190/111 |
| 2004/0182901 | A1 | 9/2004 | Godshaw et al. | |
| 2004/0244115 | A1 | 12/2004 | Adams et al. | |
| 2008/0087513 | A1 * | 4/2008 | Majeau | 190/111 |
| 2009/0008203 | A1 | 1/2009 | King et al. | |
| 2009/0032418 | A1 | 2/2009 | Hamilton | |
| 2009/0038900 | A1 | 2/2009 | Redzisz et al. | |
| 2010/0051659 | A1 | 3/2010 | Ferrari | |
| 2010/0108731 | A1 | 5/2010 | Rowe et al. | |
| 2011/0198374 | A1 * | 8/2011 | Majeau | 224/245 |

* cited by examiner

STORAGE BAG WITH SECONDARY ACCESS

REFERENCE TO RELATED APPLICATIONS

This application claims the benefit of priority under 35 U.S.C. §119(e) of U.S. provisional application Ser. No. 61/406,277 filed on Oct. 25, 2010 which is hereby incorporated by reference in its entirety.

The present invention is directed to a storage bag, and more particularly, to a storage bag with secondary access to a compartment of the storage bag.

BACKGROUND

Storage bags, such as messenger bags, laptop cases, briefcases and the like are used to store a variety of components therein, such as laptop or notebook computers, binders, notebooks, folders, books, writing instruments, and portable electronic device. The storage bags may include a main compartment in which larger components, such as a laptop or a notebook computer, may be stored. However, existing bags do not provide sufficient access to the main compartment.

SUMMARY

Accordingly, in one embodiment, the present invention is storage bag with a first compartment that can be accessed in multiple manners, while still ensuring that any components in the first compartment are securely retained therein. More particularly, in one embodiment the invention is a storage bag including an outer casing having an inner compartment configured to store a laptop computer or laptop computer-sized item therein. The bag further includes a first access opening formed at or along an upper edge of the inner compartment and communicating with the inner compartment. The first access opening is sized to allow a laptop computer or laptop computer-sized item to pass therethrough and into the inner compartment. The bag also has a second access opening formed along a back surface of the outer casing and communicating with the inner compartment. The second access opening is sized to allow a laptop computer or laptop computer-sized item to pass therethrough and into the inner compartment.

DETAILED DESCRIPTION

As shown in FIGS. 1-6, the storage bag of the present invention, generally designated 10, includes a generally rectangular prism-shaped outer casing 12. The casing 12 can be made of a relatively soft, pliable material, such as woven fabric, leather or the like with padding or other stiffening inserts received therein. The casing includes a pair of opposed major surfaces 14, 16, taking the form of front and back surfaces which are significantly larger than the other surfaces of the casing 12.

Figure 2:
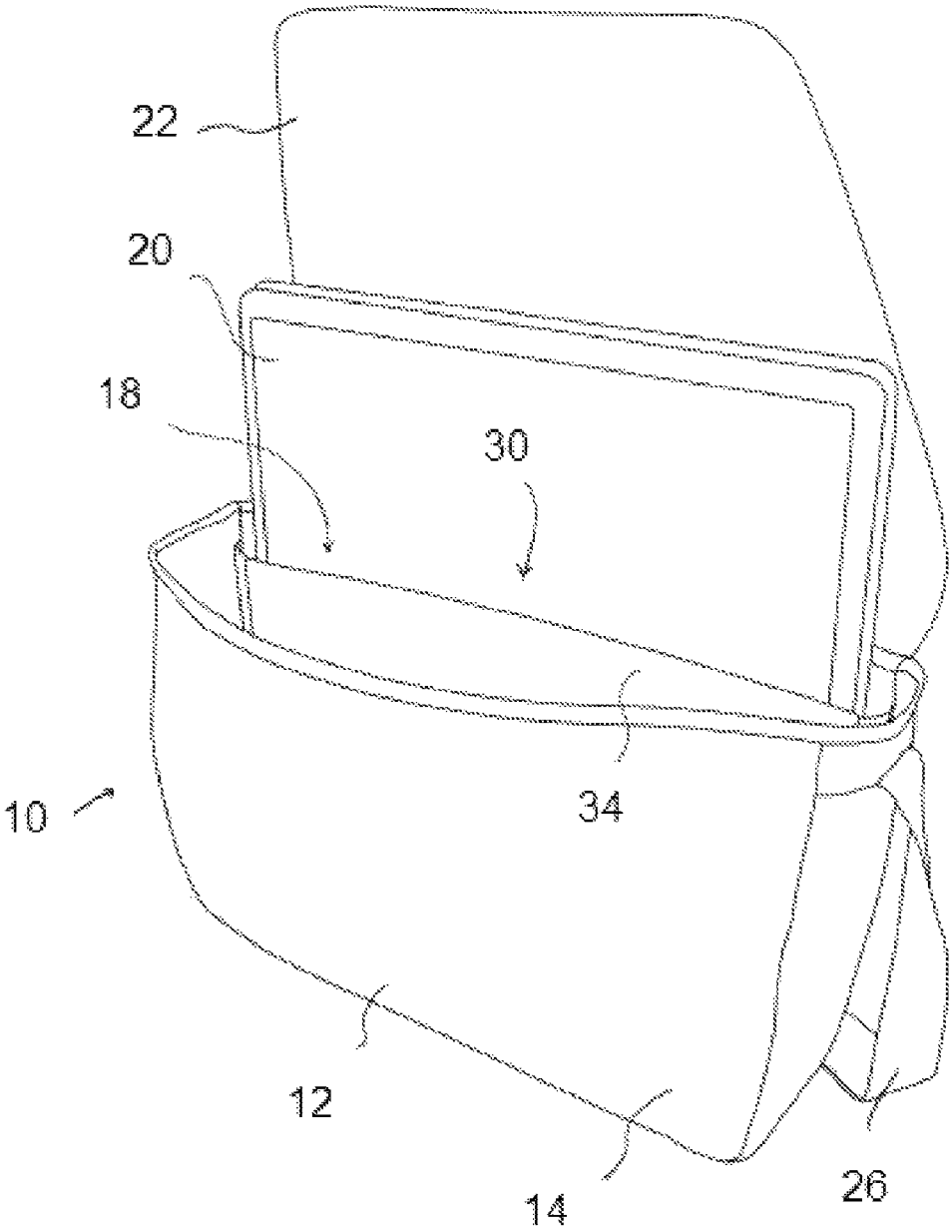
FIG. 2 is front perspective view of the bag of FIG. 1, with the front flap in a retracted position and a laptop being passed through the first access opening into an inner compartment.
Figure 3:
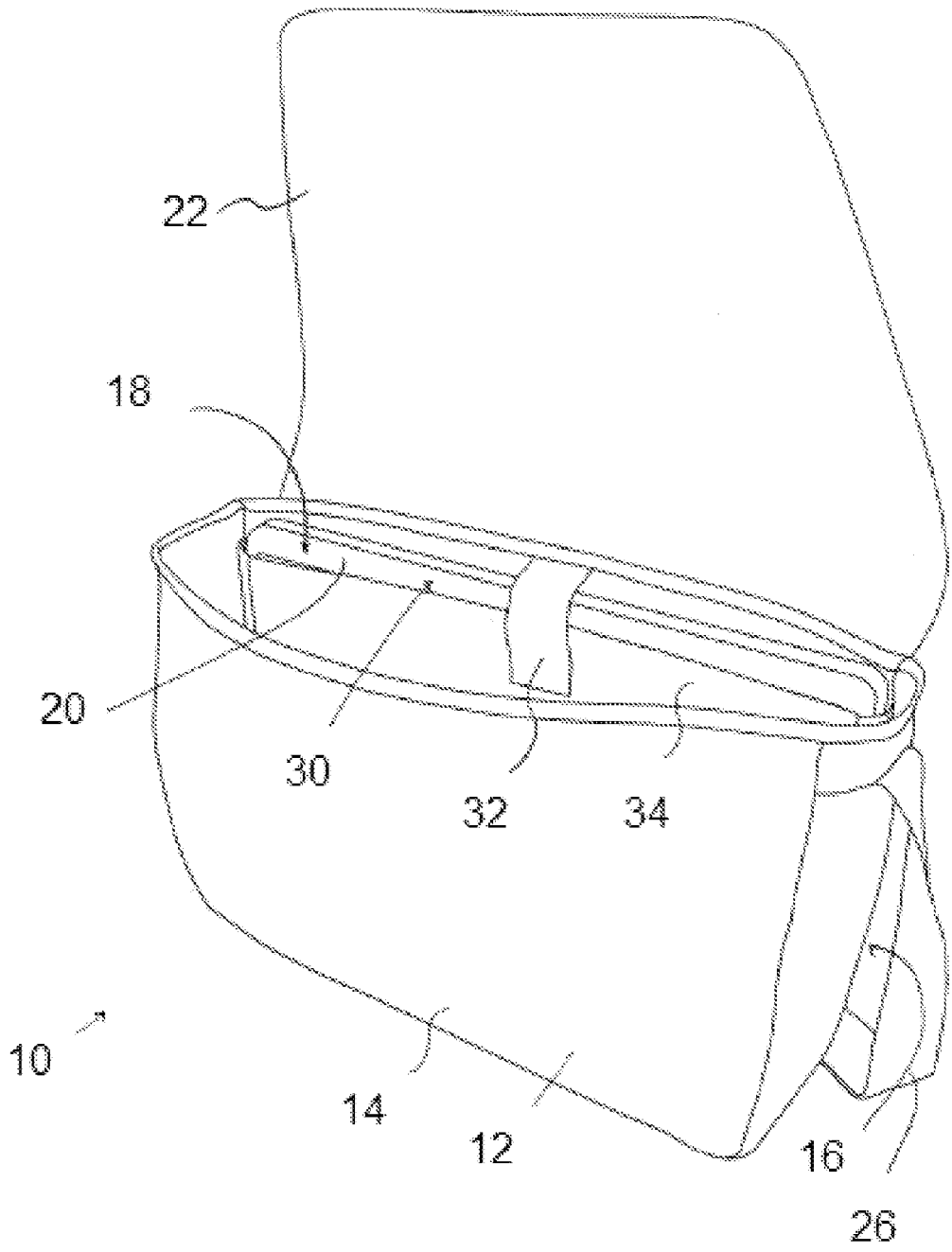
FIG. 3 is a front perspective view of the bag of FIG. 1, with the laptop fully received in the inner compartment and a retaining strap in place.
Figure 4:
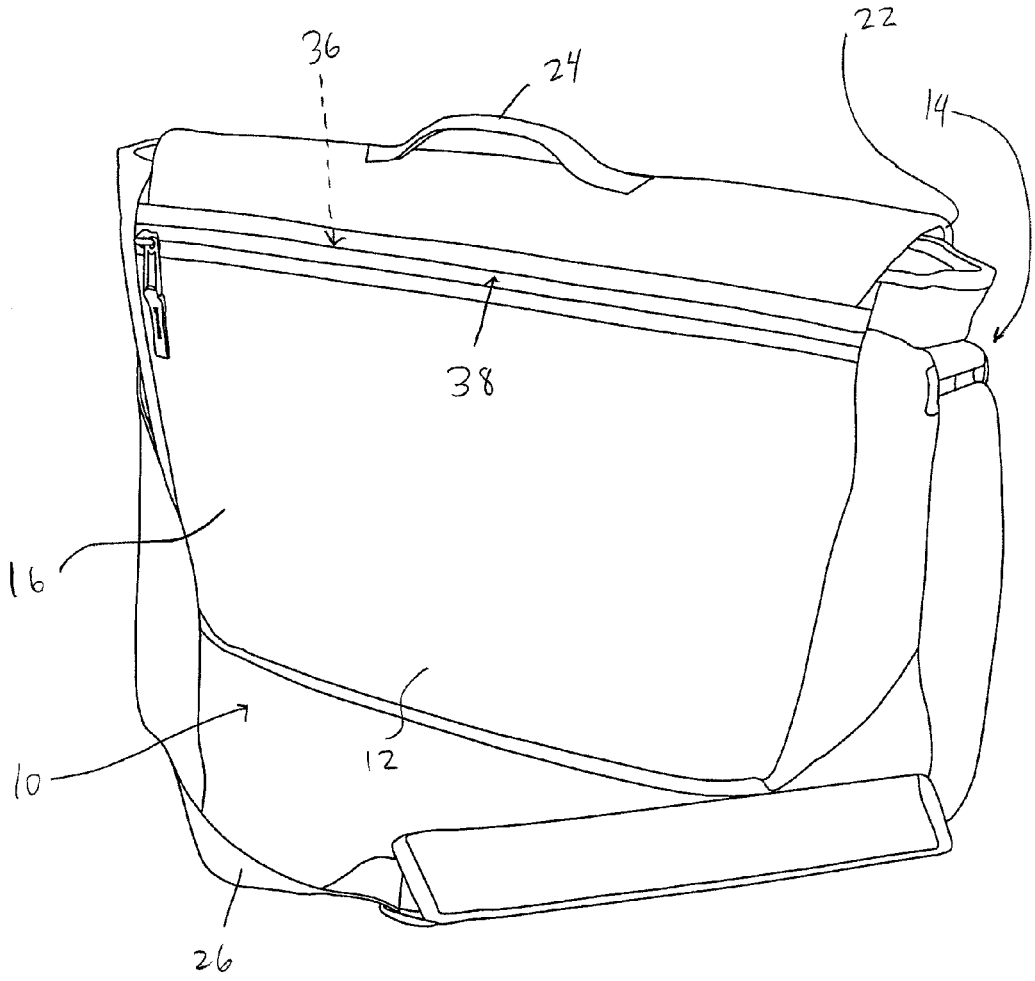
FIG. 4 is a rear perspective view of the bag of FIG. 1.
Figure 5:
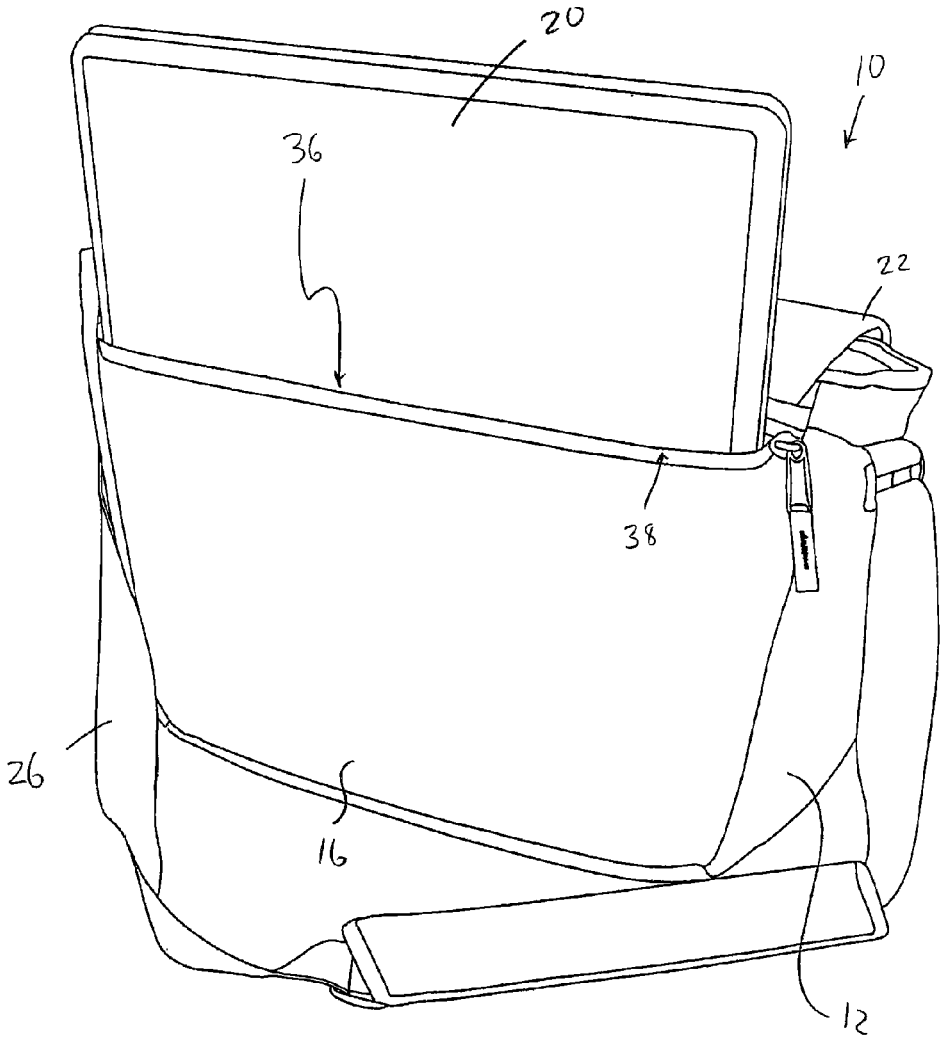
FIG. 5 is a rear perspective view of the bag of FIG. 1, with the laptop being passed through the second access opening.
Figure 6:
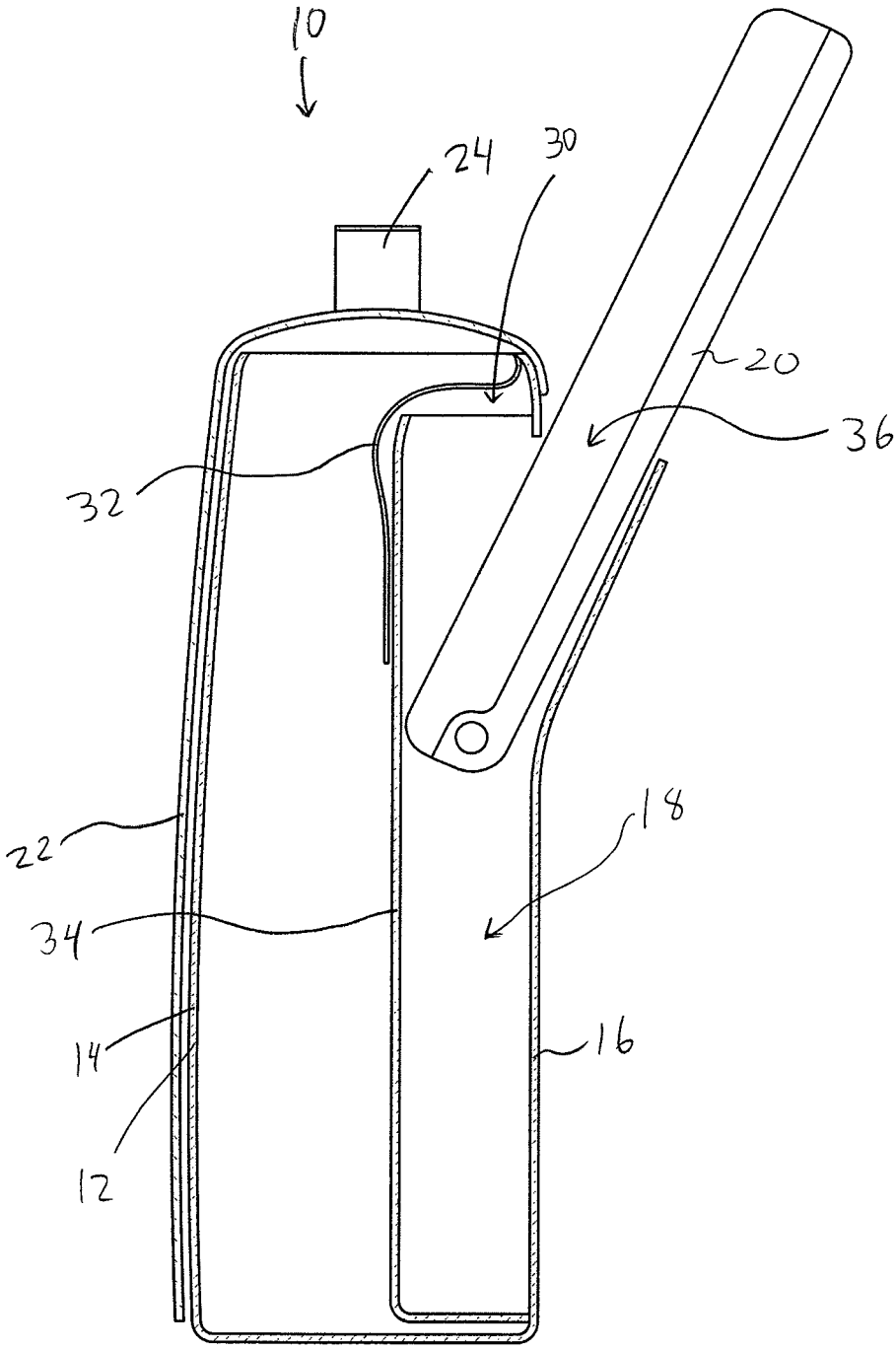
FIG. 6 is a side cross section of the bag of FIG. 5.

As best shown in FIGS. 2, 3, and 6, the bag 10 includes a first inner compartment/pocket 18 defined therein. The bag/casing 10 may include a variety of other compartments, pockets or the like for storing various components therein. However, in the illustrated embodiment, the first inner compartment 18 is a relatively large compartment/pocket of the bag 10 and extends generally the entire width, and the entire height or nearly the entire height, of the bag 10. The first inner compartment 18 may be sized and configured to store a laptop/notebook computer 20 (laptop and notebook computers being collectively termed "laptop computers" herein) or laptop computer-sized item therein. Thus, in one embodiment, the first inner compartment 18 has a width of at least about nine inches and/or less than about twenty inches, and has a height of at least about eight inches and/or less than about sixteen inches. However, these dimensions may be made larger or smaller as desired.

The storage bag 10 may include a front flap 22 pivotally coupled to an upper portion of the outer casing 12. The front flap 22 is movable between a cover position (FIG. 1), wherein the front flap 22 overlies the front surface 14, and a refracted position wherein the front flap 22 is flipped back and generally covers, and overlies, the back surface 16. The front flap 22 may be securable to the outer casing 12 in its cover position. In particular, the front flap 22 may carry a latch portion thereon (not shown) configured to releasably engage a corresponding latch portion of the front surface 14 and located near a bottom thereof. The latch portions may include snaps, clips, buttons, magnets, hook-and-loop fasteners, zippers, ties, and other means of reversibly joining the front flap 22 and the front surface 14. The illustrated flap 22 includes a handle 24 extending upwardly therefrom to provide a convenient structure by which a user can carry the bag 10. The illustrated bag 10 also includes a shoulder strap 26 secured to opposite sides of the casing 12 to provide an alternate structure for carrying the bag 10.

The storage bag 10 includes a first access opening 30 formed at or along an upper edge of the first inner compartment 18, and communicating with the first inner compartment 18. As shown in FIG. 2, when the front flap 22 is moved away from its cover position a laptop computer 20 or a laptop-computer sized item can be passed through the first access opening 30 and received in the first inner compartment 18. The bag 10 may include a first fastener or first access opening fastener (not shown) extending along the first access opening 30, or along the top edges of the bag 10, which is manually operable to open or close the first access opening 30. The first access opening fastener can take any of a wide variety of forms, such as a zipper, hooks, clasps, brackets, hook-and-loop fastening material (such as VELCRO®), etc.

When a laptop computer 20 or the like is fully received in the first compartment 18, as shown in FIG. 3, a retaining strap 32 may be utilized to secure the computer 20 in the first inner compartment 18. In particular, the illustrated embodiment, the retaining strap 32 spans the first inner compartment 18/first access opening 30 and is releasably secured to the front panel 34 of the first inner compartment 18.

The storage bag 10 further includes a second access opening 36 formed along the back surface 16 of the outer casing 12 and communicating with the first inner compartment 18. In the illustrated embodiment, the second access opening 36 extends generally parallel to the first access opening 30, and extends along substantially the entire width of the back surface 16, positioned adjacent to an upper edge of the outer casing 12. However, the second access opening may be located elsewhere on the back surface 16, such as along one of the other edges of back surface 16. The second access opening may also not be entirely parallel to an edge of back surface 16, and may extend away from one or more of the edges of back surface 16. The second access opening may also be located on, or extend onto, the area of front flap 22 that is adjacent back surface 16. The storage bag 10 may further include a second fastener or second access opening fastener 38, extending along the second access opening 36 to control opening and closing thereof. The second fastener 38 is shown as a zipper in the illustrated embodiment, although the second fastener 38 can take the form of any of a wide variety of fastening components, as described above in the context of the first fastener or the fastener between the front flap 22 and outer casing 12.

Figure 1:
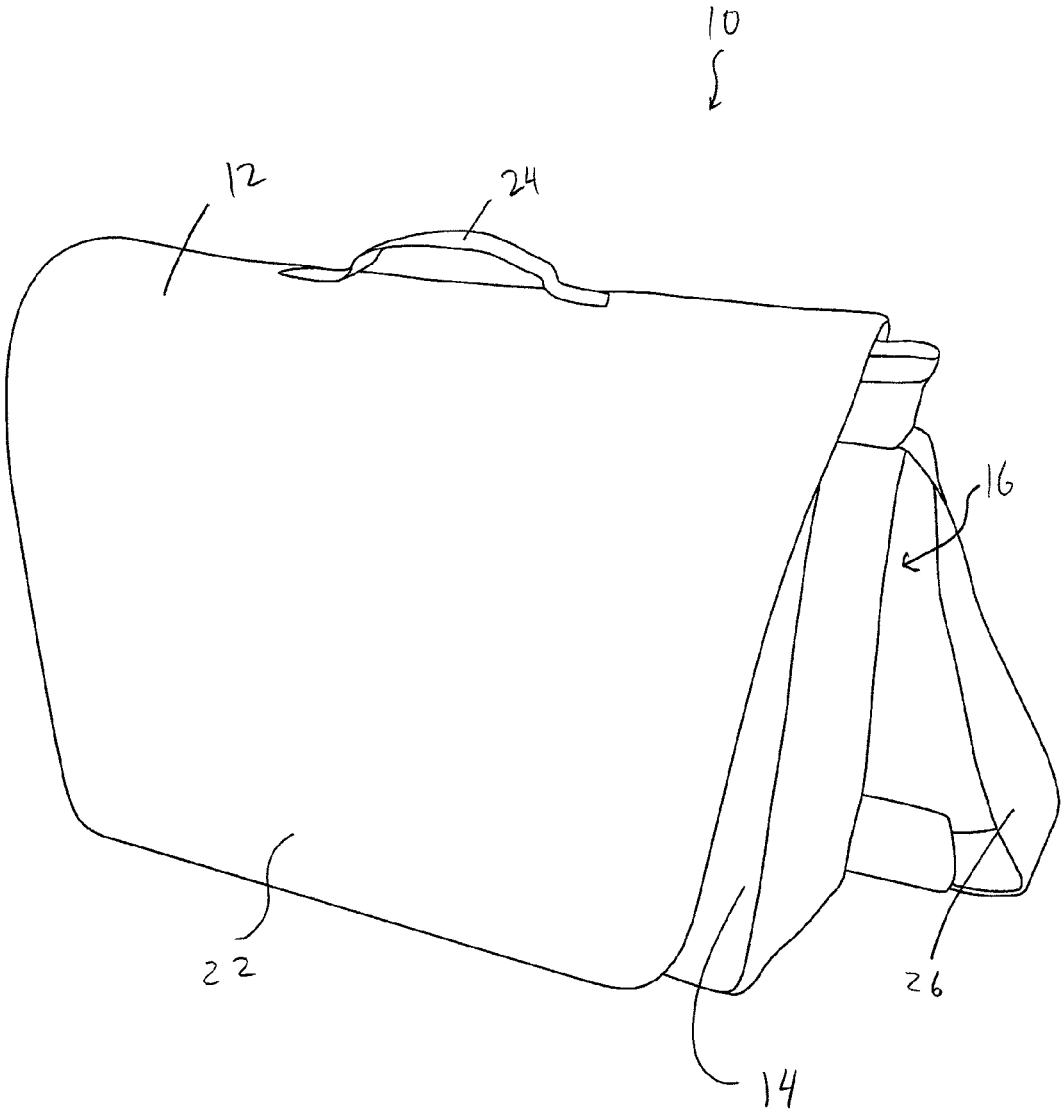
FIG. 1 is a front perspective view of one embodiment of the bag of the present invention with the front flap in the cover position.

As shown in FIG. 1, when the front flap 22 is in its cover position, the front flap 22 blocks immediate access to the first inner compartment 18 via the first access opening 30. In this case, then, it may be more convenient for the user to utilize the second access opening 36 to access the first inner compartment 18, without having to open the front flap 22. The second access opening 36 thereby provides a second, alternate manner for accessing the first inner compartment 18 to allow components to be inserted into, or removed therefrom. In addition, due to the positioning of the second access opening 36 below the retaining strap 32, components stored in the first inner compartment 18 can be removed therefrom without having to disengage the retaining strap 32. Finally, if the second access opening 36 is positioned at the top, or at least the upper portion, of the bag 10, when the second access opening 36 is left opened, items stored in the first inner compartment 18 are retained therein by gravity, preventing inadvertent spillage of items from the first inner compartment 18.

Although the invention is shown and described with respect to certain embodiments, it should be clear that modifications will occur to those skilled in the art upon reading and understanding the specification, and the present invention includes all such modifications.

The invention claimed is:

1. A storage bag comprising:

an outer casing having an inner compartment configured to store a laptop computer or laptop computer-sized item therein, wherein said inner compartment is at least partially defined by said outer casing;

a first access opening to said inner compartment formed at or along an upper edge of said inner compartment and communicating with said inner compartment, said first access opening being sized to allow a laptop computer or laptop computer-sized item to pass therethrough and into said inner compartment; and a second access opening formed along said outer casing and directly communicating with an interior of said inner compartment, said second access opening being sized to allow a laptop computer or laptop computer-sized item to pass therethrough and into said inner compartment, wherein said second access opening extends generally parallel to said first access opening.

2. The bag of claim 1 further comprising a first fastener positioned at said first opening and operable to close or open said first opening, and a second fastener positioned at said second opening and operable to close or open said second opening.

3. The bag of claim 1 further comprising a front flap coupled to said outer casing, wherein said front flap is movable to a cover position wherein said front flap overlies and generally covers said first access opening.

4. The bag of claim 3 wherein said front flap is securable to said outer casing in said cover position.

5. The bag of claim 3 wherein said front flap does not cover said second access opening when said front flap is in said cover position.

6. The bag of claim 3 wherein said front flap is movable to a retracted position in which said front flap does not overlie and does not generally cover said first access opening.

7. The bag of claim 1 wherein said outer casing is generally shaped as a rectangular prism.

8. The bag of claim 7 wherein said outer casing includes two major surface which are significantly larger than the other surfaces thereof, wherein said major surfaces are a front surface and a back surface of said casing.

9. The bag of claim 1 wherein said second access opening is positioned adjacent to an upper edge of said outer casing.

10. The bag of claim 1 further comprising a retaining strap configured to span said first access opening to prevent components from exiting from said inner compartment via said first access opening.

11. The bag of claim 10 wherein said retaining strap is releasably attachable to a front portion of said inner compartment.

12. The bag of claim 10 wherein said second access opening is positioned at least partially below said retaining strap such that said retaining strap does not block components from exiting from said inner compartment via said second access opening.

13. The bag of claim 1 wherein said inner compartment is sized to receive a laptop computer or laptop computer sized item having dimensions of at least about nine inches by about eight inches.

14. The bag of claim 1 wherein said secondary access opening is entirely positioned in a top half of said casing.

15. The bag of claim 1 wherein said outer casing is made of a flexible material.

16. The bag of claim 1 further comprising a shoulder strap.

17. The bag of claim 1 wherein said outer casing has a back surface, said inner compartment is at least partially defined by said back surface, and said second access opening is formed along said back surface.

18. The bag of claim 17 wherein said second access opening extends along substantially the entire width of said back surface.

19. A storage bag comprising:

an outer casing defining an internal volume accessible through a top portion thereof, wherein said outer casing has a front surface and a back surface;

a front flap pivotally coupled to said back surface of said outer casing that is movable between a cover position wherein said flap overlays at least a portion of said front surface of said outer casing and restricts access to said internal volume through said top portion, and a retracted position wherein said flap does not restrict access to said internal volume through said top portion; and an inner compartment contained within said internal volume with a primary access opening accessible through said top portion of said outer casing, wherein said inner compartment is configured to store a laptop computer or a laptop computer-sized item therein, and wherein said inner compartment is at least partially defined by said back surface of said outer casing, wherein said back surface of said outer casing has an opening defining a secondary access opening to the inner compartment that is accessible when the front flap of the outer casing is in the cover position.

* * * * *